United States Patent [19]

Fuchs, Jr.

[11] 4,377,943

[45] Mar. 29, 1983

[54] EXTRUSION DIE

[75] Inventor: Francis J. Fuchs, Jr., Princeton Junction, N.J.

[73] Assignee: Western Electric Co., Inc., New York, N.Y.

[21] Appl. No.: 239,855

[22] Filed: Mar. 2, 1981

Related U.S. Application Data

[63] Continuation of Ser. No. 55,673, Jul. 9, 1979, abandoned.

[51] Int. Cl.[3] ..... B21C 25/02

[52] U.S. Cl. ..... 72/467

[58] Field of Search ..... 72/467, 468, 60, 253.1, 72/272, 274

[56] References Cited

U.S. PATENT DOCUMENTS 3,641,795 2/1972 Lester et al. ..... 72/274

3,918,288 11/1975 Verduzco et al. ..... 72/467

FOREIGN PATENT DOCUMENTS 891236 9/1953 Fed. Rep. of Germany ..... 72/467

544911 7/1922 France ..... 72/467

372004 5/1973 U.S.S.R. ..... 72/467

595048 2/1978 U.S.S.R. ..... 72/467

631231 11/1978 U.S.S.R. ..... 72/467

*Primary Examiner*—Daniel C. Crane

*Attorney, Agent, or Firm*—R. F. Kip, Jr.; M. Pfeffer

[57] ABSTRACT

A hydrostatic extrusion die includes a nose-cone section (21) of a high toughness tool steel and a mating rear section (22) of a high compressive strength material such as carbide. During extrusion, inwardly directed radial forces ($F_r'$) are developed in the rear section which exactly compensates for the outwardly directed radial forces ($F_o$) developed at the throat of the die.

8 Claims, 4 Drawing Figures

EXTRUSION DIE

CROSS-REFERENCE TO RELATED APPLICATION

This is a continuation of application Ser. No. 55,673 filed July 9, 1979, now abandoned.

TECHNICAL FIELD

Broadly speaking, this invention relates to extrusion. More particularly, in a preferred embodiment, this invention relates to multi-section die for use in a hydrostatic extrusion process.

BACKGROUND OF THE INVENTION

As is well known, extrusion dies are subject to various stresses tending to destroy them or, at least, shorten their effective life. For example, in conventional extrusion the internal pressure that is generated during the extrusion process, or during start-up, tends to rupture the die. This effect is traditionally compensated for by manufacturing the die with a relatively thick die wall and/or by shrink-fitting the die into a binding ring which generates compressive pre-stresses at the bore tending to compensate for the stresses developed during extrusion. Naturally, this latter technique is limited to pre-stress values which are less than the compressive yield strength of the material used to make the die.

Unfortunately, in hydrostatic extrusion where the material to be extruded is under such extreme pressure as to cause it to flow plastically, the need to grip the workpiece and force it into the die places an upper limit on the thickness of the wall that can be used in the die. See, for example, the apparatus disclosed in U.S. Pat. No. 3,740,985 which issued June 26, 1973 to F. J. Fuchs, Jr. and which is assigned to the assignee of the instant application. Also, the limitation that the compressive pre-stress generated by the binding ring cannot exceed the compressive yield strength of the die material makes prior art solutions to premature die failure useless for hydrostatic extrusion processes.

SUMMARY OF THE INVENTION

The problem, then, is to provide an extrusion die design that is useful in, for example, hydrostatic extrusion, yet which does not suffer from the premature failures noted in the prior art. Fortunately, this problem has been solved by the instant invention which, in a preferred embodiment, comprises an extrusion chamber for receiving a billet to be extruded, the chamber having a reduced portion for receiving the billet subsequent to extrusion and an extrusion die positioned within the chamber. The die includes: (a) a nose-cone section having a first surface for redirecting the billet as it flows plastically under the pressure of the extrusion and a second surface rearwardly of the first surface; and (b) a rear section restrained from axial displacement by the chamber and having a first surface for sliding, mating engagement with the second surface of the nose-cone section, the force applied by the extruding billet, normal to the first surface of the nose-cone section, being transmitted through the nose-cone section and being converted, via the interface between the second surface of the nose-cone section and the first surface of the rear section, inter-alia into an inward radial force component which compresses the rear section, said radial compression compensating for the outward radial force which is generated in the die by the extrusion process itself.

The invention and its mode of operation will be more fully understood from the following detailed description, when taken with the accompanying drawings, in which:

DETAILED DESCRIPTION

Figure 1:
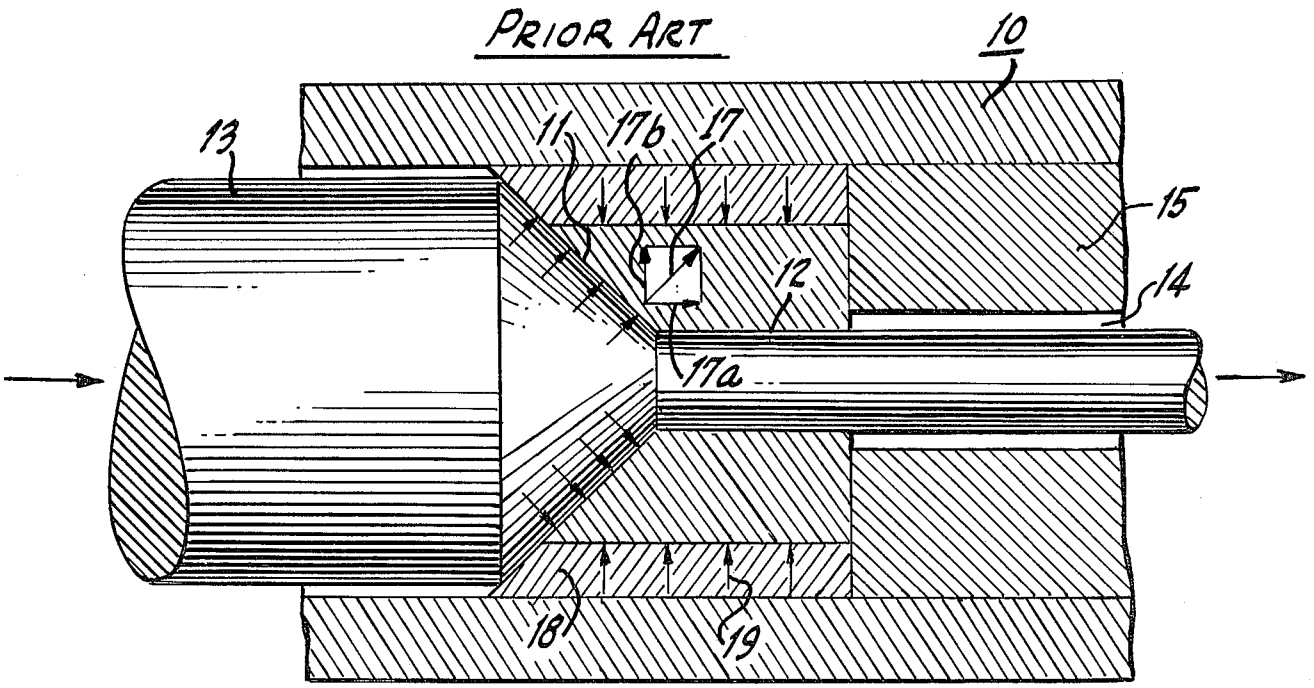
Fig. 1 PRIOR ART
FIG. 1 is a cross-section of an illustrative prior art extrusion die of conventional design.

FIG. 1 depicts a typical prior art extrusion die 10 comprising a nose-cone section 11 and a rear section 12 of reduced diameter, both sections having a substantially annular configuration in this illustrative example. A billet 13 of a material, such as aluminum or copper, is fed into the die from the left and, by virtue of the action of the nose-cone section 11, is reduced in diameter and extruded to the right through an enlarged portion 14 of a die stem 15. The means by which billet 13 is forced into die 10, as well as the means by which the extruded product is taken up at the other end, are not relevant to the instant invention and, therefore, are not shown in the drawing. Vectors 17 represent the force which is applied to the die by billet 13 as it is extruded-down to form the final product which passes through the rear section 12.

In accordance with well-known physical principles, the forces which are generated in this prior art process are normal to the surface of throat section 11. As shown, each of the force vectors 17 may be analyzed into two component vectors, **17*a* and 17*b*, which are respectively directed in the axial and radial directions. The vector 17*a* tends to displace the die to the right and may be resisted by appropriate mechanical arrangements. However, the radial vectors 17*b* comprise the previously discussed forces which tend to rupture the die and which, in the prior art, are compensated for by the use of an increased die wall thickness or the use of a shrink-fitted binding ring 18 which applies opposing radial force vectors 19 which counterbalance the radial forces 17*b***, thereby preventing rupture of the die.

Figure 2:
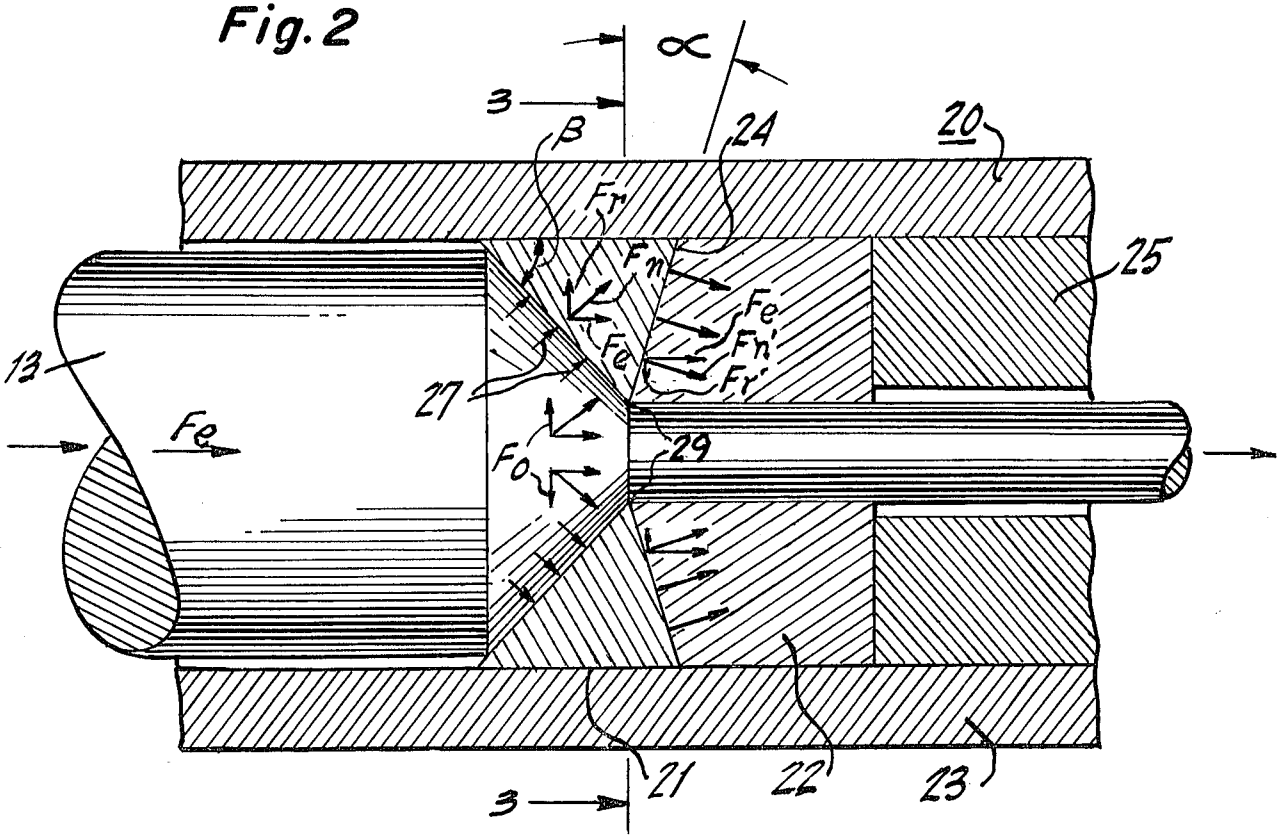
FIG. 2 is a cross-sectional view of an illustrative hydrostatic extrusion die according to the invention.

As previously mentioned, the structure shown in FIG. 1 is not entirely satisfactory for, for example, hydrostatic extrusion processes. FIG. 2, thus, depicts an illustrative hydrostatic extrusion die 20 according to the invention. As shown, die 20 comprises a nose-cone section 21 formed, for example, from a high-toughness tool steel, e.g., Vascomax 350, having a concave conical surface at its upstream face, and a rear section 22 of a high compressive strength material, for example a carbide, such as tungsten carbide, or sintered diamond. As in the case of the die shown in FIG. 1, both members 21 and 22 are of a generally annular configuration and, together with a die stem 25, are retained within a cylindrical metal housing 23 of a thickness which, of necessity, is considerably less than the wall thickness of the conventional die shown in FIG. 1. Again, the mechanism by which the billet 13 is forced inwardly of the die is not shown as it forms no part of the instant invention. The interface 24 between the nose-cone section 21 and the rear section 22 makes an angle $\alpha$ to a plane which is normal to the principal longitudinal axis of the apparatus. The front surface of the nose-cone section likewise makes an angle $\beta$ to the longitudinal axis.

Figure 3:
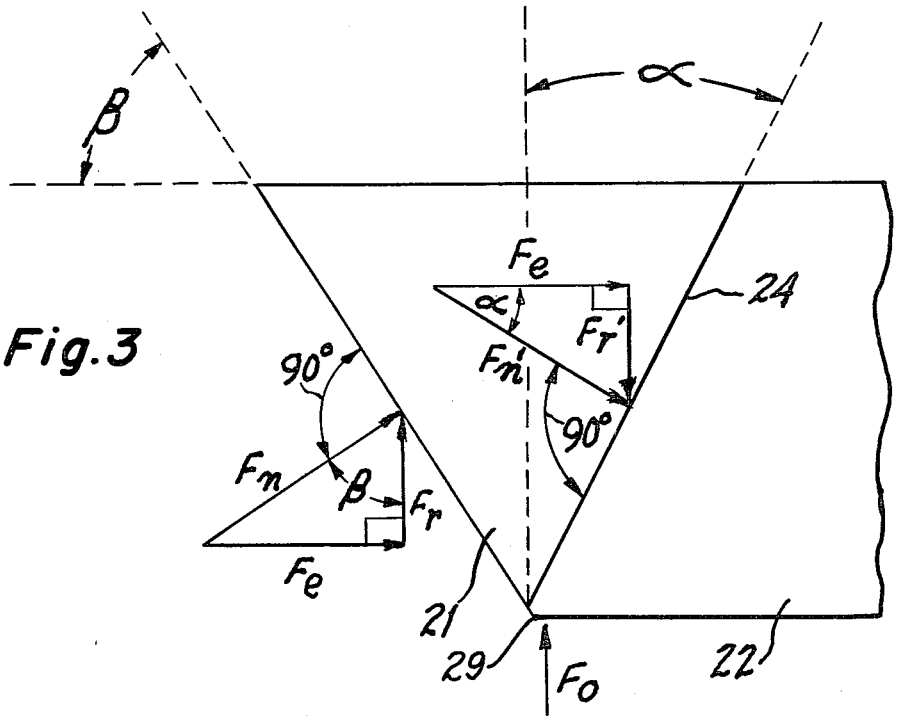
FIG. 3 is a vector diagram illustrating the forces present in the extrusion die shown in FIG. 2.

As shown in FIGS. 2 and 3, billet 13 generates force vectors 27 of magnitude $F_n$ which are normal to the surface of the nose-cone section 21. These forces are transmitted through the nose-cone section to the interface 24. Each force vector 27 may be analyzed into a radial component $F_r$ which is normal to the longitudinal axis and a second component $F_e$ which is parallel to the longitudinal axis. $F_e$ must obviously equal the force of extrusion; thus, $$F_e/F_n = \sin\beta \text{ or } F_n = F_e/\sin\beta:$$

At interface 24, the vector $F_n'$ must act normally to the surface of the interface. Again, $F_n'$ may be broken down into two orthogonal components, $F_r'$ and $F_e'$. Again $F_e'$ must be equal to the force of extrusion $F_e$. $F_r'$, the force of greatest interest, is thus expressed by the relationship:

$$F_r' = F_e \sin\alpha.$$

Figure 4:
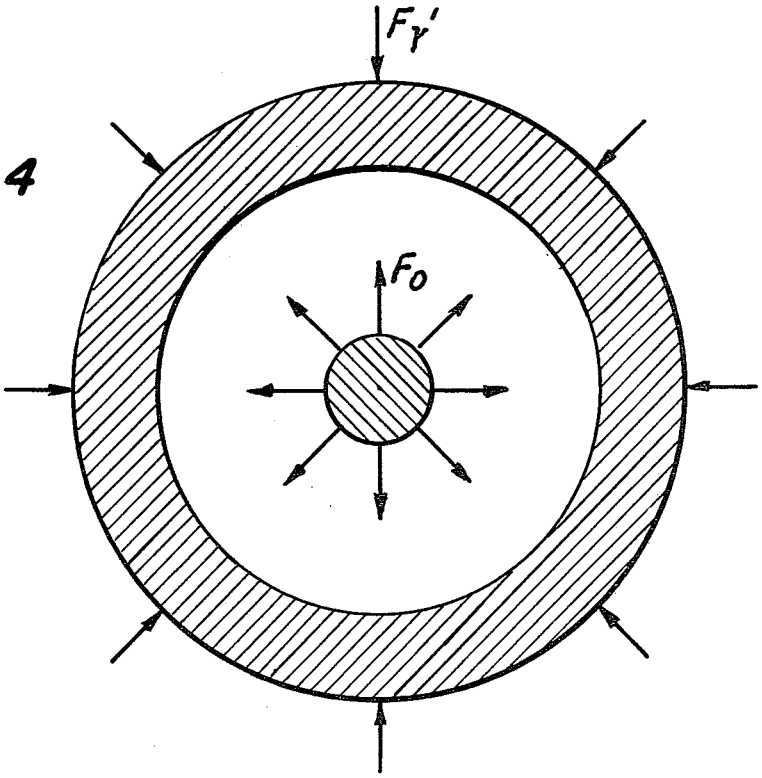
FIG. 4 is a cross-sectional view taken about line 3—3 in FIG. 2 showing the forces present at the die bore.

As best seen in FIG. 4, the radially directed vectors $F_r'$ effectively oppose and offset the effect of the outward radial vectors $F_o$ which are generated at the throat 29 of the die by the billet as it is reduced in diameter. Put another way, in the apparatus shown; the side-angle of the concave nose-cone surface is made sufficiently large so as to provide a radial inward force when the extrusion force builds-up in the axial direction. This radial inward force compresses the rear die section and, by adjusting the angle $\alpha$, may be made to exactly compensate for the internal pressure caused by the extrusion process. In FIG. 2, the nose-cone is supported by the extrusion chamber wall during start-up and by the extrusion pressure medium during continuous run. The angle will be 15° in a typical situation. The die shown in FIG. 2 was tested experimentally for a period of over 55 minutes during which a plurality of copper billets were extruded into copper wire under hydrostatic conditions.

The arrangement shown in FIG. 2 has several advantages over the prior art designs, not the least of which is that it is a dynamic rather than a static solution to the problem. That is, by varying the angle $\alpha$, it can compensate for a wide variety of extrusion pressures and speeds as well as workpiece materials. In addition, the forces generated during extrusion tend to force the nose-cone section 21 radially outward against the walls of the extrusion chamber thus, preventing the escape of hydrostatic extrusion fluid between the walls of the extrusion chamber and the nose-cone section. While the illustrative embodiment employs annular die components for extruding a cylindrical billet, it will be appreciated that a square or rectangular die could be employed for extruding non-cylindrical product.

One skilled in the art may make various changes and substitutions to the layout of parts shown without departing from the spirit and scope of the invention.

What is claimed is:

1. Apparatus for the extrusion of a billet to a desired, reduced size, which comprises:

an extrusion chamber having a longitudinal direction generally along the extrusion path and for receiving said billet prior to extrusion, said chamber having a reduced portion for receiving said billet subsequent to extrusion; and an extrusion die positioned within said chamber, said die including:

(a) a nose-cone section having a first surface angled with respect to said longitudinal direction for redirecting said billet as it flows plastically under the pressure of the extrusion, an entrance opening for the redirected billet, said opening being larger than said desired reduced size of said billet but less than the initial size thereof and a second surface rearwardly of said first surface, the second surface being angled with respect to both the first surface and said longitudinal direction such that the force applied by said extruding billet, normal to the first surface of said nose-cone section, is transmitted through said nose-cone section and is converted at the second surface thereof into a longitudinal force component and an inward force component perpendicular to said longitudinal direction; and (b) a rear section, restrained by said chamber from longitudinal displacement, having a throat portion substantially equal to the desired reduced size of the billet, and having a first surface for sliding, mating engagement with the second surface of said nose-cone section such that the inward force component at said second surface is applied to the first surface of the rear section to compress said rear section in the vicinity of the throat portion, said inward compression being of a magnitude dependent at least in part upon said angle between said second surface and said longitudinal direction such as to substantially compensate for the outward force which is generated in said die throat by the extrusion process itself.

2. The apparatus according to claim 1 wherein said billet is cylindrical, said nose-cone section and said rear section comprise annuli and the first surface of said nose-cone section has a concave conical surface at its base.

3. The apparatus according to claim 1 wherein said nose-cone section is comprised of relatively high-toughness metal and said rear section is comprised of a high compressive strength material.

4. The apparatus according to claim 3 wherein said metal comprises a tool steel.

5. The apparatus according to claim 3 wherein said high compressive strength material comprises a carbide.

6. The apparatus according to claim 3 wherein said high compressive strength material comprises sintered diamond.

7. The apparatus according to claim 1 wherein the second surface of said nose-cone section and the first surface of said rear section make an angle $\alpha$ with respect to a plane which is normal to said longitudinal direction of extrusion, the angle $\alpha$ being selected such that:

$$F_r' = F_e \tan\alpha$$

where, $F_e$=the force of extrusion, and $F_r'$=the inwardly directed force in the rear section; whereby the inward compression substantially totally compensates for the outward forces generated in the region of the throat by the extrusion process.

8. The apparatus according to claim 7 wherein the angle $\alpha$ is approximately 15°.

* * * * *